US006502359B1

(12) United States Patent
Rambo

(10) Patent No.: US 6,502,359 B1
(45) Date of Patent: Jan. 7, 2003

(54) DOWEL PLACEMENT APPARATUS FOR CONCRETE SLABS

(75) Inventor: Todd Rambo, Kennesaw, GA (US)

(73) Assignee: Bometals, Inc., Powder Springs, GA (US)

( * ) Notice: Subject to any disclaimer, the term of this patent is extended or adjusted under 35 U.S.C. 154(b) by 0 days.

(21) Appl. No.: 09/784,788

(22) Filed: Feb. 15, 2001

Related U.S. Application Data

(60) Provisional application No. 60/184,018, filed on Feb. 22, 2000.

(51) Int. Cl.[7] ..... E04B 1/68; E04F 15/14

(52) U.S. Cl. ..... 52/396.04; 52/371; 52/396.02; 52/700; 52/706; 249/9; 249/98; 404/60; 404/62; 404/88

(58) Field of Search ..... 52/396.02, 396.04, 52/704, 699, 296, 298, 706, 414, 700, 367, 371, 155, 318; 404/47, 48, 50, 60, 62, 88, 136, 64; 249/9, 98, 3

(56) References Cited

U.S. PATENT DOCUMENTS

| | | | | |
|---|---|---|---|---|
| 1,546,005 A | * | 7/1925 | Briody | |
| 3,437,018 A | * | 4/1969 | Jackson | |
| 3,628,764 A | * | 12/1971 | Burton | 249/9 |
| 4,648,739 A | * | 3/1987 | Thomsen | 404/2 |
| 4,959,940 A | * | 10/1990 | Witschi | 52/583 |
| 5,005,331 A | | 4/1991 | Shaw et al. | |
| 5,092,091 A | * | 3/1992 | Hull et al. | 52/396 |
| 5,487,249 A | | 1/1996 | Shaw et al. | |
| 5,678,952 A | | 10/1997 | Shaw et al. | |
| 5,713,174 A | | 2/1998 | Kramer | |
| 5,797,231 A | | 8/1998 | Kramer | |
| 5,826,391 A | * | 10/1998 | Underwood | 52/414 |
| 5,910,087 A | * | 6/1999 | Carter | 52/371 |
| 5,934,821 A | | 8/1999 | Shaw et al. | |
| D419,799 S | | 1/2000 | Shaw et al. | |

OTHER PUBLICATIONS

Unknown author, Concrete International Magazine, Jul. 1991, pp. 42–44.

Speed Dowel, Inc., Specifications: Spec Data Format (1988), available at http://www/speeddowel.com/specs.htm.

Speed Dowel, Inc., New Products: Speed Dowel Load Transfer System (last visited Jan. 10, 2000), available at http://www.speeddowel.com/new.htm.

* cited by examiner

*Primary Examiner*—Yvonne M. Horton
(74) *Attorney, Agent, or Firm*—Kilpatrick Stockton LLP

(57) ABSTRACT

An expendable concrete dowel placement apparatus comprising a concrete form and a dowel holder capable of quickly positioning a dowel perpendicular to the surface of the concrete form, thereby allowing the finished concrete slab to expand and contract relative to a control joint without the dowel causing the concrete to yield. The concrete form maintains a plurality of square or rectangular apertures which receive the dowel bar holders. Each dowel bar holder maintains a plurality of retention clips and a flange located at its open proximal end which positively positions the dowel bar holder within the apertures of the concrete form in a position perpendicular to the front surface of the central vertical member of the concrete form. The concrete form is composed of a non-typical shape which allows the control joint to transfer loads to adjoining concrete slabs through the length of the control joint. Additionally, loads are transferred to adjoining slabs by the dowel or plurality of dowels located within the concrete slab.

20 Claims, 4 Drawing Sheets

DOWEL PLACEMENT APPARATUS FOR CONCRETE SLABS

RELATED APPLICATIONS

This application claims priority to, and incorporates by reference, co-pending provisional patent application Ser. No. 60/184,018 filed on Feb. 22, 2000, entitled "Square Hole Key Way."

FIELD OF THE INVENTION

This invention relates to the field of concrete construction, and more particularly, to devices facilitating the placement of reinforcing dowels within a concrete slab across a control joint.

BACKGROUND OF THE INVENTION

In the design of concrete slabs formed on a grade it is necessary to account for thermal expansion and shrinkage of the concrete. One way to control the thermal expansion and contraction of concrete within a slab is through the use of an expansion joint. An expansion joint is formed by the placement of compressable materials consisting typically of wood or a composite fiber material at regular intervals throughout the slab. The compressable material allows expansion of the concrete, after curing, beyond its original volume. A second such joint that controls contraction due to loss of moisture during curing is a control joint. Control joints are more prevalent and must be placed every 100 to 200 square feet of surface area.

Generally speaking, a control joint is a cut in a concrete slab which allows the slab to contract during the curing phase of a concrete slab and expand or contract thereafter without damaging the slab. While a control joint protects the concrete slab from damage due to contraction of the concrete during curing and expansion or contraction thereafter within the slab itself, the joints prohibit loads placed on the concrete slab to be transferred uniformly throughout. As a result, control joints, without further reinforcement, leave the concrete slabs susceptible to damage. For instance, loads developed by a forklift moving across a non-reinforced control joint poses a serious risk of damage to the slab because the forklift's load at the control joint is supported by only one half of the volume of concrete as available to support the forklift in an portion of the slab without a control joint.

A way to prevent buckling or angular displacement of such control joints is to insert smooth steel dowel rods generally known as "slip dowels" within the edge portions of adjoining concrete slabs in such a manner that the concrete slabs may slide freely along one or more of the slip dowels. The slip dowels permit linear expansion and contraction of the slabs and maintain the slabs in a common plane, thus preventing undesirable buckling of the control joint. In order to function effectively, slip dowels must be accurately positioned parallel within the adjoining concrete slabs. Nonparallel positioning of the dowels often prohibits the dowels from sliding within the concrete slab, thereby defeating the purpose of the "slip dowel" application.

Traditionally, two methods of installing smooth "slip dowels" have become popular. According to the first method, a first concrete pour is made within a preexisting form. After the pour has cured, holes are drilled horizontally into the slab at corresponding intervals. The depth and diameter of the individual holes varies depending on the application and the relative size of the concrete slabs being formed. As a general rule, however, such holes are at least twelve inches deep and typically have a diameter of approximately five-eighths of an inch. After the parallel aligned series of holes have been drilled into the first pour, smooth dowel rods are advanced into each hole such that one end of each dowel rod is positioned within the first pour and the remainder of each dowel rod extends into the second formed area. Thereafter, concrete is poured into the second area and is permitted to set around the dowels. Once the concrete in the second pour has cured, the dowels are fixedly contained within the second pour and slideably contained within the first pour. Thus, the dowels are capable of transferring loads between the slabs while allowing the slabs to move along the longitudinal axes of the dowels.

While it has become popular to use this method, it is riddled with inefficiencies. First, the method requires the time intensive step of drilling multiple holes within the first cured slab. Second, the holes must be drilled precisely perpendicular to the surface of the control joint in order to ensure that the dowels will permit the concrete slabs to move longitudinally in relation to each other. In practice, such precision is difficult to achieve. Thus, this method has been proven to be an inefficient design.

Another popular method of locating slip dowels within a concrete slab has involved placing a material over one end of a dowel during the construction process, thereby enabling the dowel to slide longitudinally once the concrete has cured. This method has used wax treated cardboard sleeves, plastic sleeves, or grease alone over one end of each individual dowel. According to such method, a series of holes are drilled through one edge of a concrete form and smooth dowels are advanced through each such hole. Wax treated cardboard sleeves, plastic sleeves, or grease alone are placed over one end of each dowel and the first pour is made within the form. After the first pour has set, the previously drilled form is stripped away leaving the individual dowels extending into a second formed space where the second pour is to be made. Subsequently, the second pour is made and permitted to cure. Thereafter, the slip dowels are firmly held by the concrete of the second pour but are permitted to move longitudinally against the inner surfaces of the wax treated cardboard sleeves, plastic sleeves, or grease alone within the first pour. Thus, the wax cardboard sleeves, plastic sleeves, or grease alone allow for longitudinal slippage of the dowels while maintaining the two adjoining concrete slabs in a common plane.

While the second method has alleviated the need for drilling holes in a cured slab, it is nonetheless associated with numerous deficiencies. For instance, the second method requires that the dowels be inserted during the first pour, thereby requiring that the dowels be in place until the second pour is made. A common occurrence at this stage is for the dowels to become bent due to various actions taken at the construction site, thereby making the removal of the concrete form difficult. Additionally, the form provided no means for accurately determining whether the dowel was in correct perpendicular alignment with the concrete slab. Still yet, the system requires the removal of the concrete form prior to pouring the second area.

Although many ideas have been proposed to eliminate these problems, none have sufficiently solved these problems to date. Thus, there exists a need in the art for a devise and method for facilitating the proper placement of slip dowels while insuring proper load transfer across a control joint. Further, a need exists for increasing the efficiency of the installation process.

SUMMARY OF THE INVENTION

Set forth below is a brief summary of the invention which solves the foregoing problems and provides benefits and advantages in accordance with the purposes of the present invention as embodied and broadly described herein.

Generally speaking, in a preferred embodiment of this invention, an expendable concrete form is used to form joints within a concrete slab in order to prevent adjoining concrete slabs from cracking due to shrinkage during curing of the concrete slab. The concrete form is composed of a non-typical shape that enables each slab adjoining the concrete form to transfer loads placed on one slab to an adjoining slab in order to prevent cracking and the development of uneven slabs. Additionally, loads are transferred from one slab to an adjoining slab through dowel bars that are inserted into apertures found within the concrete form. Thus, loads are transferred between adjoining concrete slabs through dowel bars and the interlocking slab design that are created through the use of the concrete form.

The apertures, which are preferably square or rectangular, are located on a central member of the concrete form in order to position the dowel bar holder centrally within the concrete slab. The apertures are sized to receive the retention clips of the dowel bar holders. Each dowel bar holder is sized to receive a dowel bar. The dowel bar holders are composed of an open proximal end, a closed distal end, a hollow interior compartment, a plurality of internal fins, and a base member. The internal fins are attached to the interior surfaces of the vertical walls within the hollow interior compartment and operate to position the dowel bar centrally within the dowel bar holder once the dowel bar has been inserted into the dowel bar holder. The base member of the dowel bar holder is composed of a flange, a sleeve, and a plurality of retention clips. The flange further is composed of a plurality of wings.

In operation, a concrete slab is formed by first locating the concrete form in its preferred position with ground stakes. The dowel bar holder is affixed to the concrete form by inserting the retention clips of the dowel bar holder into the aperture a sufficient distance to allow the retention clips to bear against the back surface of the central member of the concrete form. Both the retention clips and the wings of the flange act to positively position the dowel bar holder in a position perpendicular to the front surface of the central member of the concrete form. This process is repeated as many times as is necessary to connect the desired number of dowel bar holders to the concrete form.

Once the dowel bar holders are positively positioned within the concrete form, the dowel bars are inserted into the dowel bar holders, preferably until each dowel bar comes to rest against the closed distal end of each dowel bar holder. Once assembly of the dowel placement apparatus is complete, the first pour area is filled with concrete. Immediately thereafter, or concurrently therewith, the second pour area is filled with concrete and allowed to cure. Once both slabs have cured, the dowel bars and the dowel bar holders are contained within the slabs. In this position, the dowel bar located with the second poured area is in direct contact with the concrete and thereby prevented from moving. However, the portion of the dowel bar housed within the dowel bar holder is not directly contacted by the concrete. Thus, this portion of the dowel bar is able to move along its longitudinal axis.

The upper and lower interior walls of the dowel bar holder prohibit the dowel bars from vertical movement. However, the dowel bars may move laterally if the dowels accept a load greater than the strength of the internal fins located in the interior walls of the dowel bar holder. Should the slabs move parallel to the control joint, the internal fins will resist the movement to a point that is slightly less than the yield point of the concrete. Once the resistance of the internal fins is overcome, the internal fins deform and allow the slabs to move along the control joint prior to the concrete cracking. Thus, the internal fins protect the concrete slabs from cracking.

An object of this invention includes an expendable form which allows for both sides of the concrete pour area to be poured at the same time rather than pouring one area, stripping the form, and subsequently pouring the second area; thereby greatly increasing the time efficiency of pouring a concrete slab.

Another object of this present invention is the superior load handling capabilities found within a square or rectangular dowel.

Yet another aspect of this invention is the use of rectangular apertures within the channel of the concrete form which allows for quick connection of the dowel holders to the expendable concrete form.

BRIEF DESCRIPTION OF DRAWINGS

The accompanying drawings, which are incorporated in and form a part of the specification, illustrate a preferred embodiment of the present invention and, together with the description, disclose the principles of the invention. In the drawings.

DETAILED DESCRIPTION OF THE DRAWINGS

Figure 1:
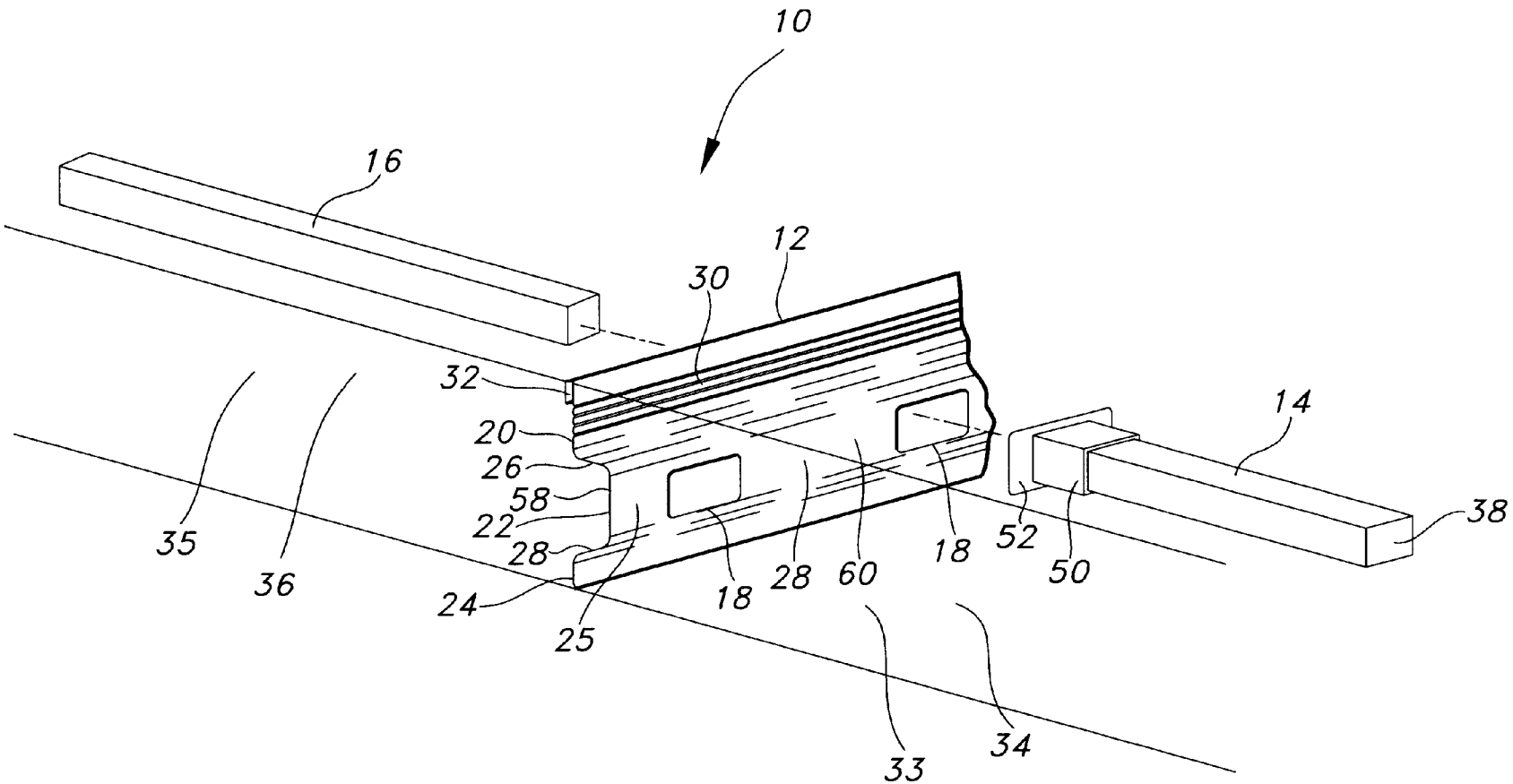
FIG. 1 is a perspective drawing of the concrete dowel placement apparatus.

This invention relates to an expendable concrete dowel placement apparatus 10 capable of positioning a dowel bar within a concrete slab. Specifically, FIG. 1 perspectively illustrates a preferred embodiment of a concrete dowel placement apparatus 10 including a concrete form 12, a dowel bar holder 14, and a dowel bar 16. The concrete form 12 is rectangular in shape and includes a plurality apertures 18, an upper vertical member 20, a lower vertical member 24, a channel 25, a plurality of longitudinal ribs 30, and horizontal stake receiving groove 32. The channel 25 includes a central vertical member 22, an upper transition member 26, a lower transition member 28. In a preferred embodiment, the concrete form 12 is used as a form between a first pour area 33 and a second pour area 35.

The concrete form 12 is advantageously designed to include a plurality of apertures 18 capable of receiving the dowel bar holder 14. The apertures 18 can be rectangular or square in shape, with a square configuration composing a subset of a rectangular configuration. The apertures 18 are sized to receive the dowel bar holder 14 and are preferably located on the central vertical member 22 in order to centrally locate the dowel bar 16 and the dowel bar holder 14 within the finished first concrete slab 34. The apertures 18 are positioned relative to each other based upon the loads anticipated to be placed on the first slab 34 and the second slab 36. The concrete form 12 is also capable of supporting the dowel bar holder 14 and dowel bar 16 during construction of the first slab 34 and the second concrete slab 36, prior to the dowel bar holder 14 receiving support from the concrete slab itself Typically, the concrete form 12 is constructed of sheet metal; however, the concrete form 12 may be constructed of materials including, but not limited to, wood, plastic, or other material capable of supporting the dowel bar holder 14 and dowel bar 16 during the construction process. While the concrete slab is described as being composed of a first slab 34 and a second slab 36, the concrete form, because of its expendability, allows for each slab to be poured at the same time, thereby creating one monolithic slab.

The concrete form 12 maintains a non-typical shape, whereby the central vertical member 22 lies in a plane different from the plane of either the upper vertical member 20 or the lower vertical member 24 and thus forms a channel 25. Such a configuration of the concrete form 12 allows the upper transition member 26 to transfer a load placed on the surface of the first slab 34 to the second slab 36. As a load is placed upon the surface of the first slab 34, the first slab 34 depresses slightly, if at all, and transfers the load to the upper transition member 26 and the dowel bar 16. Both the upper transition member 26 and the dowel bar 16 transfer the load to the second slab 36. In a reciprocating fashion, the second slab 36 is able to transfer a load applied to the second slab 36 via the dowel bar 16 and the lower transition member 28.

Figure 2:
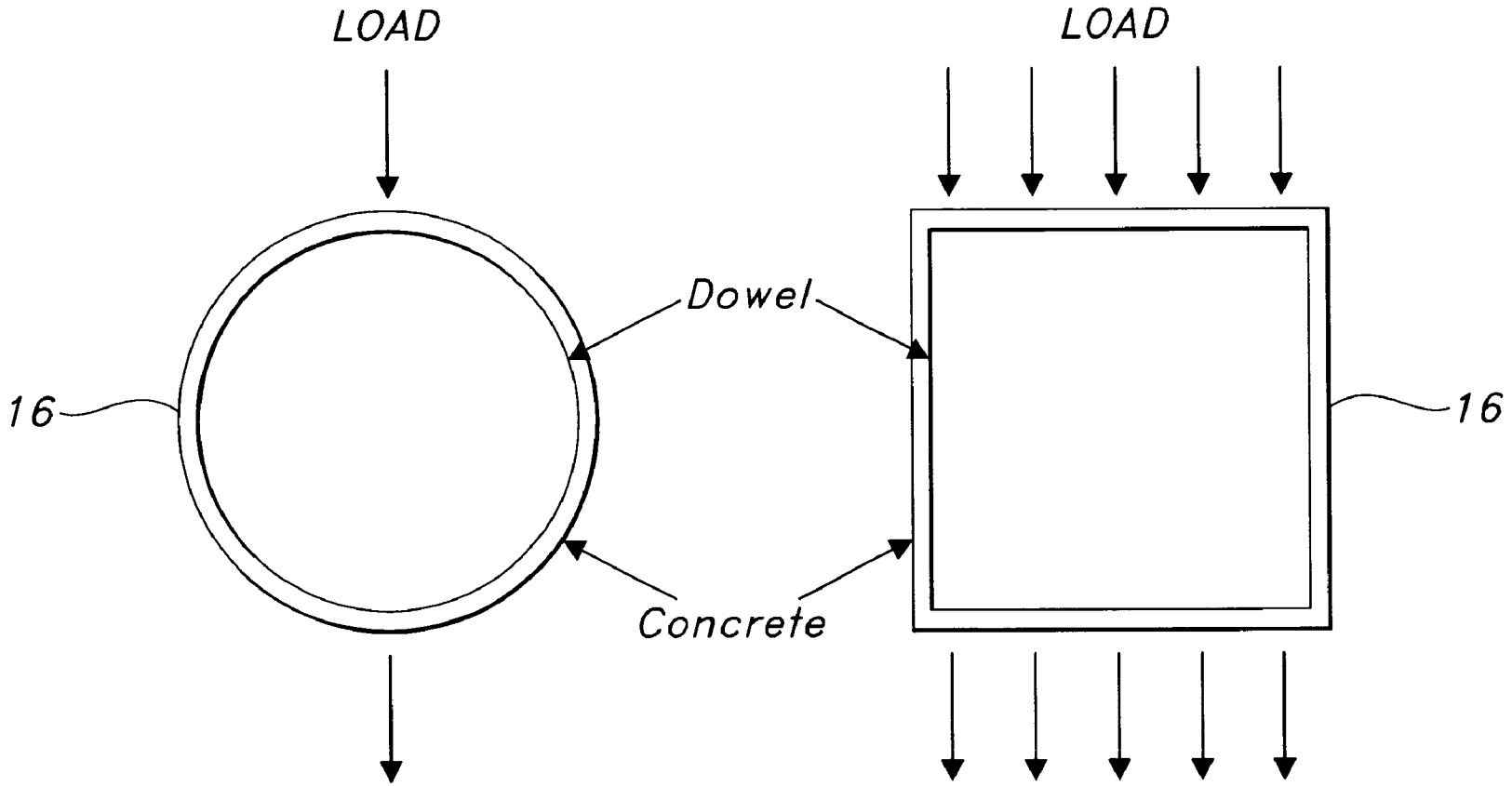
FIG. 2 is a cross-sectional view of a square dowel bar and of a round dowel bar receiving loads.

As shown in FIG. 2, the dowel bar 16 preferably maintains a rectangular configuration. Additionally, the dowel bar 16 can be square, as a square configuration is a subset of a rectangular configuration. The square dowel bar 16 is advantageous when compared with alternative designs because the square design is able to accept larger loads than alternative designs without cracking the concrete slab. Additionally, the dowel bar 16 preferably is composed of steel; however, it can be composed of another metal, alloy or other material sufficient in strength to accommodate the loads typically found in its desired application.

Figure 3A:
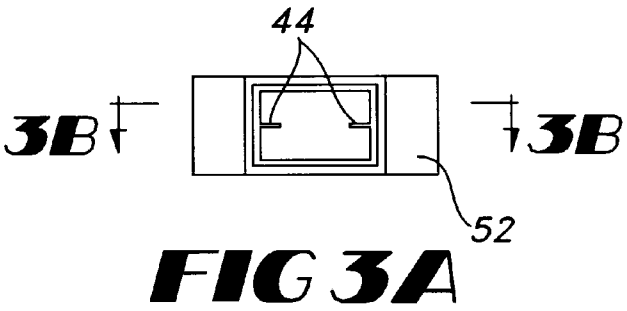
FIG. 3A is an end view of a dowel bar holder.
Figure 3C:
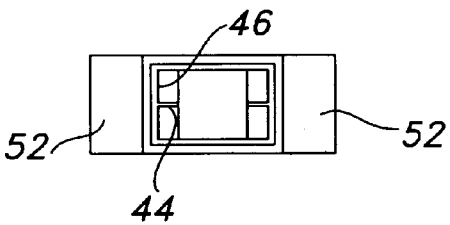
FIG. 3C is an end view of a dowel bar holder together with a dowel bar.
Figure 3B:
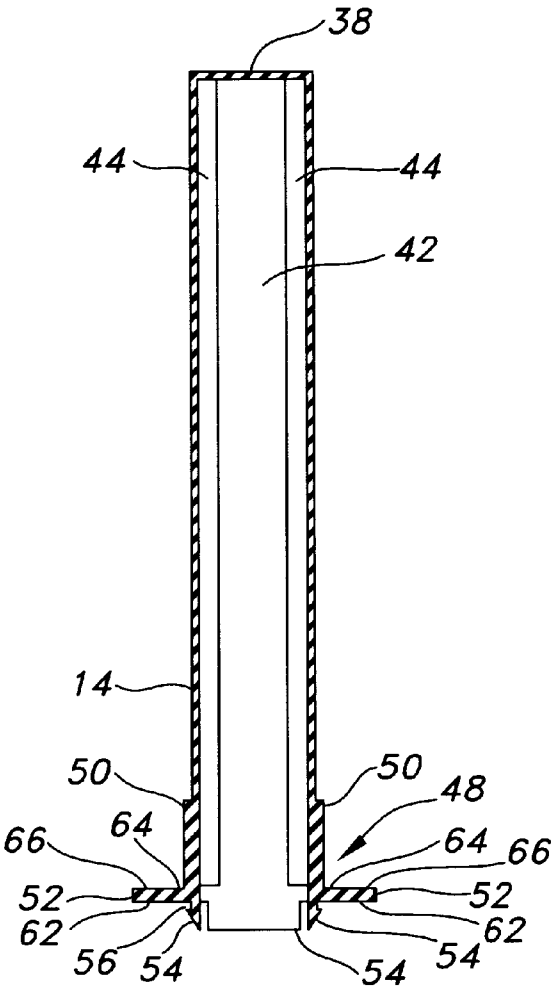
FIG. 3B is a cross-sectional view of the dowel bar holder at section 3B—3B.

Referring now to FIGS. 3A 3B and 3C, the dowel bar holder 14 preferably has a rectangular cross-sectional configuration including a closed distal end 38, an open proximal end 40, a hollow interior compartment 42 extending longitudinally therein, and a plurality of internal fins 44. Alternatively, the dowel bar holder 14 is composed of a square configuration. The hollow interior compartment 42 is sized to receive a dowel bar 16. The vertical dimension of the hollow interior compartment 42 is sized slightly larger than the dimension of the dowel bar 16. Thus, in operation, the dowel bar holder 14 prevents the dowel bar 16, the first slab 34 or the second slab 36 from experiencing vertical movement.

The internal fins 44 are located within the hollow interior compartment 42 and are affixed to the interior walls 46 of the hollow interior compartment 42. The internal fins 44 extend longitudinally from the closed distal end 38 to the open proximal end 40. Alternatively, the internal fins 44 are located at various intervals along the horizontal interior walls 46 of the dowel bar holder 16. The internal fins 44 are typically composed of a rigid plastic. However, the internal fins 44 are not designed to resist failure. Instead, the internal fins 44 are sized to fail under a load applied normal to the end of the internal fins 44 and normal to the interior wall 46 to which the internal fin 44 is affixed, that is less than the force necessary to cause the first slab 34 or second slab 36 to yield. Such failure of the internal fins 44 protects the first slab 34 and the second slab 36 from failure.

The dowel bar holder 14 further includes a base 48, having a sleeve 50, a flange 52, a plurality of retention clips 54, and a retention gap 56, disposed on the open proximal end 40 of the dowel bar holder 14. The flange 52 includes a proximal surface 62, a distal surface 64, and a plurality of wings 66. The retention clips 54 are preferably releasable snap fittings that allow the dowel bar holder 14 to be attached and removed from the concrete form 12. The retention gap 56 between the retention clip 54 and the flange 52 must be sized slightly greater than the thickness of the central vertical member 22 in order to allow the retention clip to properly seat against the back surface 58 of the central vertical member 22. Preferably, sleeve 50, flange 52, and retention clips 54 are incorporated within the dowel bar holder 14 and form one unit. Alternatively, the base 48 is a separate member of the concrete dowel placement apparatus 10 and is fixedly attached to the open proximal end 40 of the dowel bar holder 14 through the use of various mechanical connections. The sleeve 50 provides lateral and longitudinal support for the dowel bar holder 14 during construction of the first slab 34. Additionally, the wings 66 of flange 52 supports the dowel bar holder 14 during construction of the first slab 34 and correctly position the dowel bar holder 14 perpendicular to the front surface 60 of the central vertical member 22.

The concrete dowel bar apparatus 10 is not limited to using retention clips 54. Alternatively, the dowel bar holder 14 can be positively positioned within the aperture 18 with examples such as, but not limited to, a plurality of fasteners, a plurality of prongs, an adhesive, or an interference fitting. Still yet, the aperture 18 could be flanked with small wings that enable the dowel bar holder 14 to be held in place by inserting screws through the wings and into the sidewalls of the dowel bar holder 14.

In operation, the concrete form 12 is placed in a preferred position in order to prepare a pour area, whereby a first concrete slab 34 and a second concrete slab 36 is formed. The concrete form 12 is positioned in place by first driving stakes into the ground. The concrete form 12 is then attached to the stake at the stake receiving groove 32. Once the concrete form 12 has been positioned, the retention clips 54 of the dowel bar holder 14 are inserted into an aperture 18. The dowel bar holder 14 is held in position through the cooperation of the flange 52, the wings 66, and the retention clips 54. Upon insertion of the retention clips 54 into the aperture 18, the retention clips 54 flex inward, toward the longitudinal axis of the dowel bar holder 14. Once the dowel bar holder 14 has been inserted into the aperture 18 a sufficient distance, the retention clips 52 return to their original position.

While the dowel bar holder 14 is connected to the concrete form 12, the retention clips 54 contact the back surface 58 of the central vertical member 22. The retention clips 54 positively position the dowel bar holder 14 and prevent accidental removal of the dowel bar holder 14 from the concrete form 12. In addition, flange 44 surrounds the base 48 and positively positions the dowel bar holder 14 within the aperture 18 of the concrete form 12. Further, the wings 66 of the flange 54 position the dowel bar holder 14 within the aperture 18 preferably perpendicular to the front surface 60 of the concrete form 12. The wings 66 may be either rectangular, as shown, or another shape sufficient to provide the stability necessary to position the dowel bar holder 14 within the concrete form 12. When the dowel bar holder 14 is positioned within the aperture 18, it is preferable that the flange 52 and wings 66 contact the front surface of the central vertical member 22. The flange 52, the wings 66, and the retention clips 54 position the dowel bar holder 14 preferably in a perpendicular position.

The dowel bar 16 is positioned in the dowel bar holder 14 with the interior fins 44 of the hollow interior compartment 34. Preferably, the internal fins 26 contact each side of the dowel bar 16 and the interior walls 46 contact the top and bottom surfaces of the dowel bar 16. Once the dowel bar 16 is inserted into the dowel bar holder 14, preferably half of the length of the dowel bar 16 protrudes into the second pour area 35.

Once the concrete form 12 and the multiple dowel bar holders 14 have been positioned, a first pour of concrete is made within the first pour area 33 containing the dowel bar holders 14. The first pour area 33 is poured so that the concrete encapsulates the dowel bar holders 14 and abuts the front surface 60 of the concrete form 12. Unlike other applications, the concrete form 12 preferably is not removed after the first pour area 33 has been poured. Instead, the concrete form 12 is expendable and remains within the slab. Soon thereafter or simultaneously with the first pour, concrete is poured into the second pour area 35. Thereafter, the concrete encapsulates the dowel bar 16 located within the second pour area 35.

Figure 4:
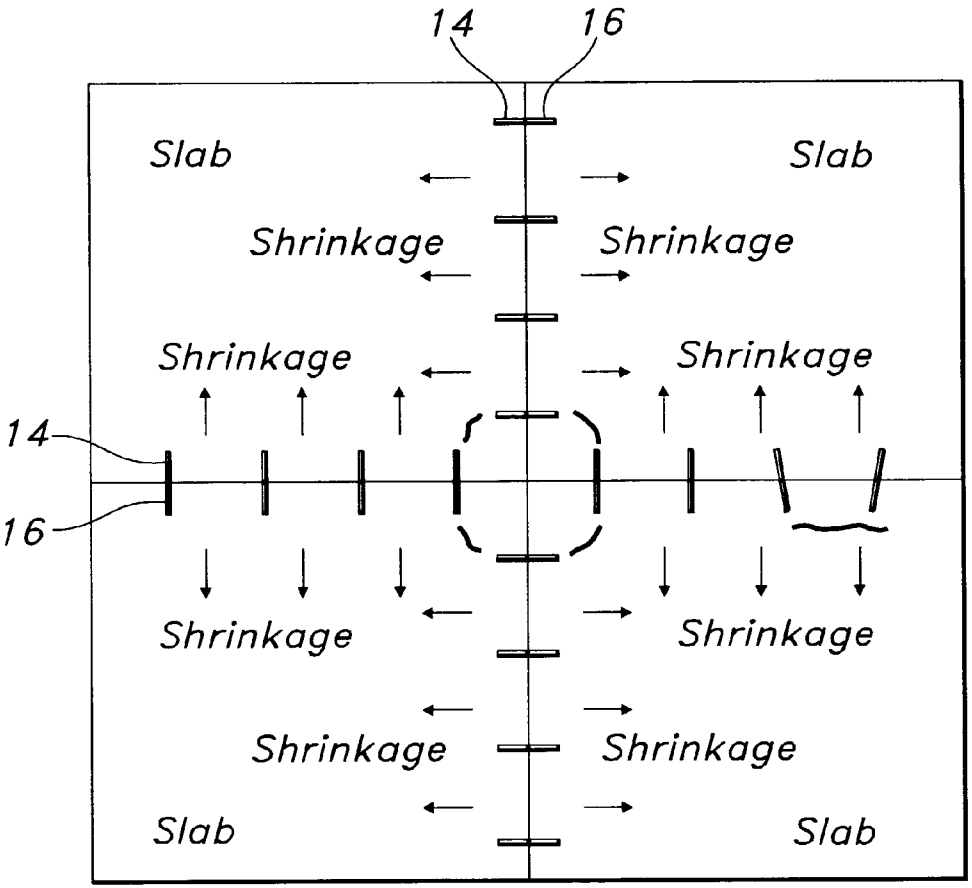
FIG. 4 is a top plan view of a finished concrete slab incorporating dowel bars and dowel bar holders therein.

Once the concrete dowel placement apparatus 10 is encapsulated within a concrete slab, the dowel bar 16 is prohibited from movement within the second slab 36. However, the dowel bar 16 may slide longitudinally, as shown in FIG. 4, within the dowel bar holder 14, located in the first slab 34, as guided by the internal fins 36. Providing such freedom of movement allows the concrete within the slabs to shrink during curing and expand or shrink thereafter without cracking and damaging the slab itself. Additionally, should the concrete slabs move laterally with respect to each other along the concrete form 12, the internal fins 36 can deform and change shape in order to accommodate the lateral movement of the first slab 34 in relation to the second slab 36, without cracking the concrete slab itself.

While various embodiments of this invention have been set forth above, these descriptions of the preferred embodiment are given for purposes of illustration and explanation. Variations, changes, modifications, and departures from the systems and methods disclosed above may be adopted without departure from the spirit and scope of this invention.

I claim:

1. A concrete dowel placement apparatus, comprising:

a rigid concrete form, including a vertical wall with a channel, including a front surface and a back surface, extending at least partially the length of the form, the form including at least one rectangular aperture;

a dowel receiving holder, including an open proximal end, a distal end, and an interior portion, said interior portion including at least one internal crushable fin, said open proximal end including a sleeve, a flange, and at least one retention clip, said flange including a proximal face, a distal face, and at least one wing extending from the flange, and said at least one retention clip protruding from the proximal face of the flange and including a releasable snap fitting adapted to retain the channel to the dowel receiving holder;

the dowel receiving holder adapted to be retained against said aperture of said concrete form at the proximal end of the dowel receiving holder, at the proximal face of the flange and at the at least one wing, and adapted to extend from a surface of the channel;

a dowel, including a rectangular cross-section, partially disposed within said interior portion of said dowel receiving holder, wherein said dowel is capable of moving back and forth along a longitudinal axis of said dowel receiving holder.

2. The concrete dowel placement apparatus of claim 1, wherein the dowel comprises a square cross-section.

3. The concrete dowel placement apparatus of claim 1, wherein the retention clips comprise prongs.

4. The concrete dowel placement apparatus of claim 1, wherein the retention clips comprise an interference fit.

5. The concrete dowel placement apparatus of claim 1, wherein the flange includes at least two retention clips.

6. The concrete dowel placement apparatus of claim 1, wherein the flange includes four retention clips.

7. The concrete dowel placement apparatus of claim 1, wherein the rigid concrete form comprises plastic.

8. The concrete dowel placement apparatus of claim 1, wherein the rigid concrete form comprises metal.

9. The concrete dowel placement apparatus of claim 1, wherein the dowel bar holder is adapted to extend from the front surface of the rigid concrete form.

10. A concrete slab, comprising:

concrete;

a plurality of joints; and a concrete dowel placement apparatus, including:

a rigid concrete form, including a vertical wall with a channel, including a front surface and a back surface, extending at least partially the length of the form, the form including at least one rectangular aperture;

a dowel receiving holder, including an open proximal end, a distal end, and an interior portion, said interior portion including at least one internal crushable fin, said open proximal end including a sleeve, a flange, and at least one retention clip, said flange including a proximal face, a distal face, and at least one wing extending from the flange, and said at least one retention clip protruding from the proximal face of the flange and including a releasable snap fitting adapted to retain the channel to the dowel receiving holder;

the dowel receiving holder adapted to be retained against said aperture of said concrete form at the proximal end of the dowel receiving holder, at the proximal face of the flange and at the at least one wing, and adapted to extend from a surface of the channel; and a dowel, including a rectangular cross-section, partially disposed within said interior portion of said dowel receiving holder, wherein said dowel is capable of moving back and forth along a longitudinal axis of said dowel receiving holder.

11. The concrete dowel placement apparatus of claim 10, wherein the dowel comprises a square cross-section.

12. The concrete dowel placement apparatus of claim 10, wherein the retention clips comprise prongs.

13. The concrete dowel placement apparatus of claim 10, wherein the retention clips comprise an interference fit.

14. The concrete dowel placement apparatus of claim 10, wherein the flange includes at least two retention clips.

15. The concrete dowel placement apparatus of claim 10, wherein the flange includes four retention clips.

16. The concrete dowel placement apparatus of claim 10, wherein the rigid concrete form comprises plastic.

17. The concrete dowel placement apparatus of claim 10, wherein the rigid concrete form comprises metal.

18. A method of reinforcing a joint in a concrete slab, comprising:

providing a rigid concrete form, including a vertical wall with a channel, including a front surface and a back surface, extending at least partially the length of the form, the form including at least one rectangular aperture;

providing a dowel receiving holder, including an open proximal end, a distal end, and an interior portion, said interior portion including at least one internal crushable fin, said open proximal end including a sleeve, a flange, and at least one retention clip, said flange including a proximal face, a distal face, and at least one wing extending from the flange, and said at least one retention clip protruding from the proximal face of the flange and including a releasable snap fitting adapted to retain the channel to the dowel receiving holder;

locating said rigid concrete form in a preferred position within a first pour area;

attaching said dowel receiving holder to said metallic concrete form at said aperture;

inserting a dowel within said interior portion of said dowel receiving holder; and making a first pour of concrete within said first pour area about said dowel receiving holder and said front side of said rigid concrete form and concurrently making a second pour of concrete within a second pour area about said dowel, said dowel fixedly contained by the second pour.

19. The method of claim 18, wherein the dowel comprises a square cross-section.

20. The method of claim 18, wherein the retention clips comprise prongs.

* * * * *